US011332974B2

(12) United States Patent
Chiquin

(10) Patent No.: US 11,332,974 B2
(45) Date of Patent: May 17, 2022

(54) BOTTOM RAIL BAR CONNECTABLE TO A SHADE IN DIFFERENT OPERATIVE ORIENTATIONS

(71) Applicant: Vertilux Limited, Medley, FL (US)

(72) Inventor: Edwin Chiquin, Miami, FL (US)

(73) Assignee: VERTILUX LIMITED, Medley, FL (US)

( * ) Notice: Subject to any disclaimer, the term of this patent is extended or adjusted under 35 U.S.C. 154(b) by 0 days.

(21) Appl. No.: 16/839,715

(22) Filed: Apr. 3, 2020

(65) Prior Publication Data

US 2021/0310299 A1 Oct. 7, 2021

(51) Int. Cl.
*E06B 9/42* (2006.01)

(52) U.S. Cl.
CPC ..... *E06B 9/42* (2013.01)

(58) Field of Classification Search
CPC ..... E06B 9/262; E06B 9/38; E06B 9/42
USPC ..... 160/265, 368.1
See application file for complete search history.

(56) References Cited

U.S. PATENT DOCUMENTS 1,909,109 A * 5/1933 Kopfstein ..... E06B 9/42 160/384
2,549,905 A 4/1951 Jablon
3,297,075 A 1/1967 Howell et al.
3,402,421 A 9/1968 Weber
3,417,519 A 12/1968 Hitter
3,454,073 A 7/1969 Man
3,524,491 A * 8/1970 Olson ..... A47H 23/01 160/393
4,122,559 A 10/1978 Kelly
4,197,896 A 4/1980 Reichstadt
D259,810 S 7/1981 Dallaire
D260,183 S 8/1981 Dallaire
4,393,915 A * 7/1983 Olson ..... E06B 9/17046 160/384
D271,055 S 10/1983 Cascone et al.
4,452,294 A * 6/1984 Fukuchi ..... A47H 23/01 160/384
D294,321 S 2/1988 Olofsson
(Continued)

FOREIGN PATENT DOCUMENTS

AU 2009203048 A8 * 10/2015 ..... E06B 9/42
BG 6230-0011 9/2006
(Continued)

OTHER PUBLICATIONS

Bing Search, http://www.quebanana.com/tienda/ver/herrajesmarino/145224, Aug. 22, 2013.
(Continued)

*Primary Examiner* — Beth A Stephan
(74) *Attorney, Agent, or Firm* — Malloy & Malloy, PL

(57) ABSTRACT

A bottom rail for a flexible material shade including an elongated base dimensioned and configured to be connected to the shade. The base has a hollow interior, extending along the length thereof, and including a plurality of cavities extending interiorly along the length of the base. The plurality of cavities are symmetrically disposed relative to a major axis of the base and are cooperatively structured with the base to be connected to a free end of the shade in different operative orientations, methods styles, etc.

18 Claims, 6 Drawing Sheets

(56) References Cited

U.S. PATENT DOCUMENTS 4,840,216 A 6/1989 John
4,935,988 A 6/1990 Ford et al.
4,987,943 A 1/1991 Charest
5,137,073 A 8/1992 Huang
5,232,039 A 8/1993 Shapiro et al.
5,259,687 A 11/1993 John
5,271,687 A 12/1993 Holka et al.
D345,498 S 3/1994 Fraser et al.
5,296,964 A 3/1994 Shopp
5,330,821 A 7/1994 Lo
D353,209 S 12/1994 Dallaire et al.
D355,094 S 2/1995 Josephson
D355,604 S 2/1995 De Baschmakoff
5,647,421 A * 7/1997 Hoffmann ..... E06B 9/40 160/120
D382,651 S 8/1997 Colitto
D382,652 S 8/1997 Colitto
5,803,144 A 9/1998 Ives
D405,194 S 2/1999 Kenkel
5,924,255 A 7/1999 Vagedes
5,975,186 A 11/1999 Day
D429,588 S 8/2000 Smederod
6,111,694 A 8/2000 Shopp
6,173,825 B1 1/2001 Liu
6,196,508 B1 3/2001 Nijs
6,202,967 B1 3/2001 Fraczek
D440,099 S 4/2001 Hortsen
6,230,782 B1 5/2001 Reichert
6,234,233 B1 5/2001 Biro
6,269,909 B1 8/2001 Grimes et al.
6,408,922 B2 6/2002 Desrochers
D468,453 S 1/2003 Schrader
6,532,109 B1 3/2003 Shopp
D479,934 S 9/2003 Colson et al.
6,666,251 B2 12/2003 Ikle
D489,209 S 5/2004 Goldberg
6,739,373 B1 5/2004 Liu et al.
D492,809 S 7/2004 Weitgasser
D494,401 S 8/2004 Davies et al.
6,817,399 B2 11/2004 Berman et al.
6,817,402 B1 11/2004 Fraczek et al.
6,978,821 B2 * 12/2005 Welfonder ..... E06B 9/17046 160/178.1 R
7,048,028 B2 5/2006 Wolfe et al.
D530,967 S 10/2006 Smith
7,141,164 B2 11/2006 Slack et al.
7,168,475 B2 1/2007 Colson et al.
D537,173 S 2/2007 Westphal et al.
7,195,052 B2 3/2007 Nien et al.
D542,068 S 5/2007 Watkins et al.
7,210,513 B2 5/2007 Goldenberg et al.
D557,116 S 12/2007 Zakowski
7,353,857 B2 4/2008 Koop
7,367,536 B1 5/2008 Anderson et al.
7,380,582 B1 6/2008 Anderson et al.
D573,267 S 7/2008 Brinton et al.
D577,138 S 9/2008 Kitagawa et al.
D591,442 S 4/2009 Ford et al.
D596,435 S 7/2009 Wills
D599,051 S 8/2009 Wu et al.
D604,885 S 11/2009 Ford et al.
7,614,439 B2 * 11/2009 Lukos ..... E04F 10/0633 160/310
D616,567 S 5/2010 Desrosiers et al.
D616,568 S 5/2010 Desrosiers et al.
7,770,625 B2 8/2010 Lukos
D634,573 S 3/2011 Risher
7,921,602 B2 4/2011 Ohanesian
7,997,041 B2 8/2011 Slack et al.
8,016,013 B2 * 9/2011 Horvath ..... E06B 9/54 160/23.1
D652,568 S 1/2012 Trzesniowski
8,136,569 B2 3/2012 Bohlen et al.
8,220,520 B2 7/2012 Lukos
D675,050 S 1/2013 Garcia
D680,357 S 4/2013 Wills et al.
8,480,048 B2 7/2013 Krantz-Lilienthal
8,528,623 B2 9/2013 Roberts
D691,398 S 10/2013 Chou
D692,685 S * 11/2013 Chou ..... D6/580
D694,039 S 11/2013 Licciardi Di Stefano
8,584,317 B2 11/2013 Liebscher et al.
D697,335 S 1/2014 Dekker et al.
D699,976 S 2/2014 Chou
D710,128 S 8/2014 Garcia
D715,629 S 10/2014 Grubb et al.
8,960,621 B2 2/2015 Wills
9,004,142 B2 4/2015 Marocco
9,060,636 B2 6/2015 Cannaverde
D740,589 S 10/2015 Ng
D742,138 S * 11/2015 Chou ..... D6/580
D753,933 S 4/2016 Ng
D759,400 S 6/2016 Watkins
D762,398 S 8/2016 Ng
9,498,079 B2 11/2016 Sanchuk
D775,939 S 1/2017 Ng
D780,945 S 3/2017 Guillemi
D789,454 S 6/2017 Prisnie
D791,580 S 7/2017 Chou
D793,765 S * 8/2017 Chou ..... D6/580
D808,684 S 1/2018 Santilli
D808,685 S 1/2018 Raiti
9,976,346 B2 * 5/2018 Ng ..... E06B 9/42
D822,228 S 7/2018 Wang et al.
D828,052 S 9/2018 Bouroullec et al.
D833,175 S 11/2018 Miroshnichenko et al.
D843,130 S 3/2019 Bacal
D843,131 S * 3/2019 Chou ..... D6/580
10,309,153 B2 6/2019 McPherson et al.
D854,192 S 7/2019 Rokvic
D854,855 S 7/2019 Garcia Garcia
D854,856 S 7/2019 Garcia Garcia
10,544,621 B2 1/2020 Mocanu et al.
D878,103 S 3/2020 Bacal
10,619,412 B2 4/2020 Chen et al.
D885,084 S 5/2020 Chiquin
10,648,230 B2 * 5/2020 Holt ..... E06B 9/262
D911,064 S 2/2021 Holt et al.
D920,004 S 5/2021 Chiquin
D940,477 S 1/2022 Chiquin
2003/0178276 A1 9/2003 Fraczek et al.
2004/0129391 A1 * 7/2004 Gottschall ..... E06B 9/42 160/238
2004/0182522 A1 9/2004 Strand et al.
2005/0247413 A1 11/2005 Nien et al.
2005/0269044 A1 12/2005 Nien
2006/0000559 A1 1/2006 Bohlen
2006/0049325 A1 3/2006 Jung
2006/0113046 A1 6/2006 Prince et al.
2006/0243402 A1 11/2006 Chang
2007/0169900 A1 7/2007 Chen et al.
2007/0221344 A1 9/2007 Beach et al.
2007/0284051 A1 12/2007 Grimes et al.
2008/0035281 A1 * 2/2008 Kirby ..... E06B 9/42 160/265
2008/0245489 A1 10/2008 Chuang et al.
2009/0229767 A1 9/2009 Mullet et al.
2009/0250177 A1 10/2009 Byeon
2009/0258752 A1 10/2009 Bohlen et al.
2010/0101741 A1 4/2010 Koop
2010/0175838 A1 7/2010 Faller et al.
2010/0300631 A1 12/2010 Sullivan
2011/0006176 A1 1/2011 Krantz-Lilienthal
2011/0049071 A1 * 3/2011 Hart ..... E06B 9/48 211/124
2011/0114809 A1 5/2011 Ng
2012/0012262 A1 1/2012 Santoro et al.
2012/0031572 A1 2/2012 Ng et al.
2012/0061034 A1 * 3/2012 Ng ..... E06B 9/17046 160/290.1
2012/0097346 A1 * 4/2012 Ng ..... E06B 9/42 160/264
2012/0255686 A1 10/2012 Huang
2013/0048229 A1 2/2013 Dwarka

(56) References Cited

U.S. PATENT DOCUMENTS

| | | | | |
|---|---|---|---|---|
| 2013/0068405 | A1 | 3/2013 | Lava et al. | |
| 2013/0098563 | A1 | 4/2013 | Jang | |
| 2013/0176743 | A1 | 7/2013 | Pfund et al. | |
| 2014/0009519 | A1 | 1/2014 | Kumagai et al. | |
| 2014/0048218 | A1 | 2/2014 | Ng | |
| 2014/0251558 | A1* | 9/2014 | Chou | E06B 9/50 160/323.1 |
| 2014/0262076 | A1 | 9/2014 | Mullet et al. | |
| 2014/0305602 | A1 | 10/2014 | Kirby et al. | |
| 2014/0352897 | A1 | 12/2014 | Mullet et al. | |
| 2015/0027059 | A1 | 1/2015 | Lu et al. | |
| 2015/0047792 | A1 | 2/2015 | Lukosiunas et al. | |
| 2015/0075726 | A1* | 3/2015 | Byun | E06B 9/38 160/84.04 |
| 2015/0240851 | A1 | 10/2015 | Giacometti et al. | |
| 2015/0275571 | A1 | 10/2015 | Guhl | |
| 2015/0292261 | A1* | 10/2015 | Chou | E06B 9/262 160/138 |
| 2015/0292262 | A1* | 10/2015 | Miller | E06B 9/13 160/270 |
| 2015/0297014 | A1 | 10/2015 | Cannaverde | |
| 2015/0368970 | A1 | 12/2015 | Chambers et al. | |
| 2016/0032646 | A1* | 2/2016 | Fleischman | E06B 9/58 160/309 |
| 2016/0051074 | A1 | 2/2016 | Choue | |
| 2016/0090779 | A1 | 3/2016 | Nurre et al. | |
| 2016/0130869 | A1* | 5/2016 | Cheng | E06B 9/40 160/309 |
| 2016/0298375 | A1 | 10/2016 | Wagner et al. | |
| 2016/0326800 | A1 | 11/2016 | Marocco | |
| 2016/0340972 | A1 | 11/2016 | Chou | |
| 2017/0009519 | A1* | 1/2017 | Marocco | E06B 9/24 |
| 2017/0079459 | A1 | 3/2017 | Filko | |
| 2017/0114593 | A1 | 4/2017 | Hebeisen et al. | |
| 2018/0087319 | A1 | 3/2018 | McPherson et al. | |
| 2018/0202157 | A1 | 7/2018 | Neal | |
| 2019/0264499 | A1* | 8/2019 | Mcneill | E06B 9/34 |
| 2019/0352963 | A1 | 11/2019 | Jang | |
| 2020/0131846 | A1 | 4/2020 | Hebeisen et al. | |
| 2020/0208464 | A1 | 7/2020 | Guest et al. | |
| 2020/0355026 | A1* | 11/2020 | Liu | E06B 9/42 |

FOREIGN PATENT DOCUMENTS

| | | | | |
|---|---|---|---|---|
| BG | 6230-0016 | | 9/2006 | |
| BR | 3020120013798 | | 2/2013 | |
| BR | 3020120056900 | | 3/2016 | |
| CN | 2012300548304 | | 3/2013 | |
| CN | 2012303568969 | | 4/2013 | |
| CO | 07051520 | | 5/2007 | |
| CO | 282 | | 7/2012 | |
| EM | 000113899-0003 | | 4/2003 | |
| EM | 000275839-0002 | | 12/2004 | |
| EM | 000279633-0001 | | 1/2005 | |
| EM | 000518923-0001 | | 4/2006 | |
| EM | 000795752-0001 | | 9/2007 | |
| EM | 001084370-0013 | | 2/2009 | |
| EM | 001102875-0002 | | 3/2009 | |
| EM | 0013369940001 | | 7/2012 | |
| EM | 003342013-0012 | | 8/2016 | |
| GB | 2052622 | | 12/1995 | |
| GB | 2391577 | A * | 2/2004 | E06B 9/17046 |
| MX | 38640 | | 5/2013 | |
| PE | 002031-2018 | | 1/2019 | |
| WO | WOD068016-0004 | | 6/2006 | |
| WO | WOD086931-0004 | | 6/2015 | |

OTHER PUBLICATIONS

Rollashade, Rollashade Contract Series, Feb. 5, 2018.

Rolleaseacmeda, System Quick Reference Guide; https://www.rolleaseacmeda.com/docs/default-source/default-document-library/edge-side-channels_qrg_us_v1-0.pdf?sfvrsn=0&sfvrsn=0, Feb. 5, 2018.

* cited by examiner

BOTTOM RAIL BAR CONNECTABLE TO A SHADE IN DIFFERENT OPERATIVE ORIENTATIONS

BACKGROUND OF THE INVENTION

Field of the Invention

This invention is directed to a bottom rail including, but not limited to, a bottom rail hem bar for a roller type, flexible material roller shade having an elongated configuration and a hollow interior. The hollow interior comprises a plurality of cavities cooperatively structured with the remainder of the base to facilitate connection thereof to a free end of the shade in a plurality of different operative orientations, styles and/or methods.

Description of the Related Art

Window treatments of various types are used both domestically and commercially throughout most industrialized countries of the world. Such known and/or conventional window treatments include, but are not limited to, drapes, curtains, shutters, blinds, shades, etc.

Perhaps one of the oldest forms of window treatment includes shade structures, or more specifically roller shades, comprising a flexible material fabric, film, etc. initially stored in surrounding relation to a supporting, cylindrical roller. The roller is rotationally mounted generally at the top end or edge of the window and the flexible material shade is rolled downwardly, from the supporting roller, into covering relation with the window. The shade, when in its operative, shading orientation is generally dimensioned to cover substantially the entirety of the window for purposes of restricting light and viewing through the window.

The popularity of such roller shades is due, at least in part, to their comparatively low cost, ease of operation and effectiveness in providing the desired or required amount of shade. Further the flexible shade material utilized can vary significantly in both size, configuration and decorative features.

Other features incorporated within such a conventional roller shade or otherwise usable therewith is the ability to further restrict light passing through the window by movably positioning the edges of the shade into side channels connected to or integrated within the longitudinal sides of the window frame. When such side channels are used, light is prevented or significantly restricted from passing between the opposite longitudinal edges of the flexible material shade and the correspondingly disposed sides of the window frame.

Additional structural and operative features associated with this type of window treatment including the use of a bottom rail or weight bars dimensioned and structured to be connected to a bottom free end and/or edge of the shade. The bottom rail is utilized to help extend the shade and remove any wrinkles in the fabric, thereby positioning it in its intended overlying, covering and shading orientation relative to at least a majority of the window.

The popularity of roller type shades has also led to various types of the bottom rails. Accordingly, bottom rails for flexible material shades may vary in size, configuration and weight. However, one problem associated with the utilization of conventional bottom rails is that each may differ in the manner in which it is operatively connected to the free end of the shade. As a result, a user of such roller shade type window treatment may have to completely replace the bottom rail of a given shade structure if the type of operative connection to the free end of the shade is no longer desired or structurally appropriate.

Therefore, there is a need in the art and industry associated with window treatments and in particular flexible material roller shade structures, for a bottom rail which overcomes the disadvantages and problems of the type set forth above. In more specific terms, a proposed and improved bottom rail would be structured to assume different operative orientations by virtue of different types of attachments or connections to the free end of the flexible material shade. Further, an improved bottom rail structure would preferably be dimensioned and configured to assume any one of a plurality of different operative orientations in a stable and reliable manner. Also, if a change in the operable orientation of the improved bottom rail is desired or required, it can be easily accomplished without requiring a replacement thereof for a bottom rail having different structural and operative features.

SUMMARY OF THE INVENTION

The present invention is directed to a bottom rail for a roller shade assembly of the type including a flexible material shade member positioned in a rolled configuration about a support roller and which typically includes a clutch, a spring or a motor and is disposed at the top end of a window being treated.

As set forth in greater detail hereinafter, the structural and operative features of the bottom rail allow it to be connected to the bottom free end of the flexible shade in any one of a plurality of operative orientations. This structural versatility allows the same bottom rail to be attached in different ways to the free end of the shade material thereby individually defining different operative orientations when so connected.

In more specific terms, the bottom rail includes an elongated base dimensioned and configured to be connected to the free end of the shade and having a length sufficient to extend along substantially the entirety of the transverse dimension of the flexible material shade. Further, the base may be formed by extrusion from a plastic, aluminum or other appropriate material and as such has an at least partially hollow interior extending along the length thereof.

The hollow interior comprises and/or is defined by a plurality of cavities all or at least some of which extend along substantially the entirety of the length of the hollow interior, due at least in part to the extruded formation of the base. Also, the base includes an elongated slot or channel-like opening formed preferably in an upper peripheral portion of the base and extending along substantially the entirety of the base. This opening communicates with the hollow interior of the base and is disposed and dimensioned to facilitate passage of the free end of the shade into the hollow interior, dependent on the operative orientation, style, method, etc. of the base/bottom rail when connected to the shade.

In at least one preferred embodiment, the plurality of cavities disposed within and at least partially defining the hollow interior include a retainer cavity, a connector cavity and at least one, but preferably two receiving cavities. Moreover, the retainer cavity is structured to receive a retainer therein. The retainer may be in the form of an elongated retaining rod, which may be disposed in retaining engagement with at least a portion of the free end disposed within the hollow interior as the free end passes through the aforementioned elongated channel or opening. Additional features of the retainer may include the forming of the elongated retaining rod from a variety of different materials. As a result, additional weight, when desired or required, may be added to the bottom rail by forming the retaining rod from a heavier metallic material rather than a lighter weight plastic material. When such a metallic or other heavier material is utilized, the retainer and/or retaining rod may be accurately described as including a weighted construction.

The aforementioned connector cavity is disposed, dimensioned and configured to receive, retain and removably engage a connector which serves to removably secure end caps to the different open end of the base, as described in greater detail hereinafter. As also more fully described, the intended versatile utilization of the bottom rail, includes a preferred overall configuration of the base and configuration and disposition of the plurality of cavities. Accordingly, the base may be formed into an elongated elliptical configuration having a major axis disposed in at least partial alignment with the flexible shade and its upward and downward direction of travel, when the base is connected thereto. In cooperation with the elongated elliptical configuration of the base, the plurality of cavities are collectively disposed in a symmetrical relation relative to the major axis of the elliptical base. Therefore, due to the configuration of the base and the symmetrical disposition of the plurality of cavities, the bottom rail will reliably demonstrate stability in its location and/or position, when attached to the bottom free end of the shade material. Also, the elongated elliptical configuration of the base may allow it to be fitted within many, if not most, existing side rails of window frames being shaded.

For purposes of clarity, at least one embodiment of the base, specifically including the plurality of cavities, comprises the inclusion of one retainer cavity and one connector cavity which may be disposed and/or interconnected to one another in close proximity. However, the interior portions of the retainer and connector cavities are segregated in order to avoid a wrongful attachment of the aforementioned end cap to a correspondingly disposed open end of the base.

The collective symmetrical disposition of the plurality of cavities is further defined by the inclusion of two opposed receiving cavities disposed on opposite sides of and in equally spaced relation to the major axis of the elliptically shaped base and hollow interior. Either of the receiving cavities are disposed, dimensioned and configured to receive a portion of the free end of the shade passing into the hollow interior through the aforementioned elongated peripheral opening or channel formed in a periphery of the base. The free end may be so disposed in a retaining engagement in one of the preferably two receiving cavities, dependent on the operative orientation of the bottom rail which defines a manner of attachment of the base/bottom rail to the free end of the flexible material shade.

Therefore, in at least one preferred embodiment the aforementioned collective symmetrical disposition of the plurality of elongated cavities, within the hollow interior, may be even more specifically defined by the major axis passing concurrently through the substantial center of both the retainer cavity and the connector cavity and between and in equally spaced relation to both of the preferably two opposed receiving cavities.

As set forth above, the base of the bottom rail may also include two end caps removably connected in covering relation to different ones of two oppositely disposed open ends of the base. The two end caps may be attached in the manner indicated to the base of the bottom rail, dependent at least in part, on the operative orientation of the base/bottom rail when connected to the free end of the shade. As such, the end cap comprises a plurality of fingers extending outwardly from an inner surface thereof. Each of the fingers are cooperatively disposed, dimensioned and configured to be telescopically received into a correspondingly dimensioned and/or configured spaces of the hollow interior and/or one or more of the plurality of cavities.

In at least one embodiment, a plurality of three fingers are secured to the inner surface of the end cap. At least one of the plurality of three fingers is dimensioned and configured to be telescopically received within an open space of the hollow interior located adjacent to the connector cavity. In cooperation therewith, two others of the plurality of three engaging fingers are disposed in spaced relation to one another at generally an upper end of the end cap and are angularly or otherwise oriented to be telescopically received within different ones of the receiving cavities. It is emphasized that the number, disposition, dimension and configuration of the plurality of fingers associated with the end cap may vary and still be considered within the spirit and scope of the present invention. In order to assure a fixed, stable but removable attachment of the end cap to one of the open ends of the base, a separate connector, such as a screw or the like, passes through an appropriate aperture in the end cap and into the aforementioned connector cavity. As a result, the connector may be removably threaded or otherwise removably mate with the interior surface portions of the connector cavity.

Therefore, the bottom rail which could include, but not be limited to a bottom rail hem bar, includes a base with a preferred elongated elliptical shape, having a hollow interior including a plurality of collectively symmetrical cavities, all cooperatively structured to facilitate attachment to the free end of a shade in a plurality of different operative orientations, styles, methods, etc. Further by way of non-limiting example, the plurality of different operative orientations, styles, methods, etc. may include, but not be limited to, an external, exposed orientation; and enclosed hem bar orientation and a covered, wrapped orientation.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 4:
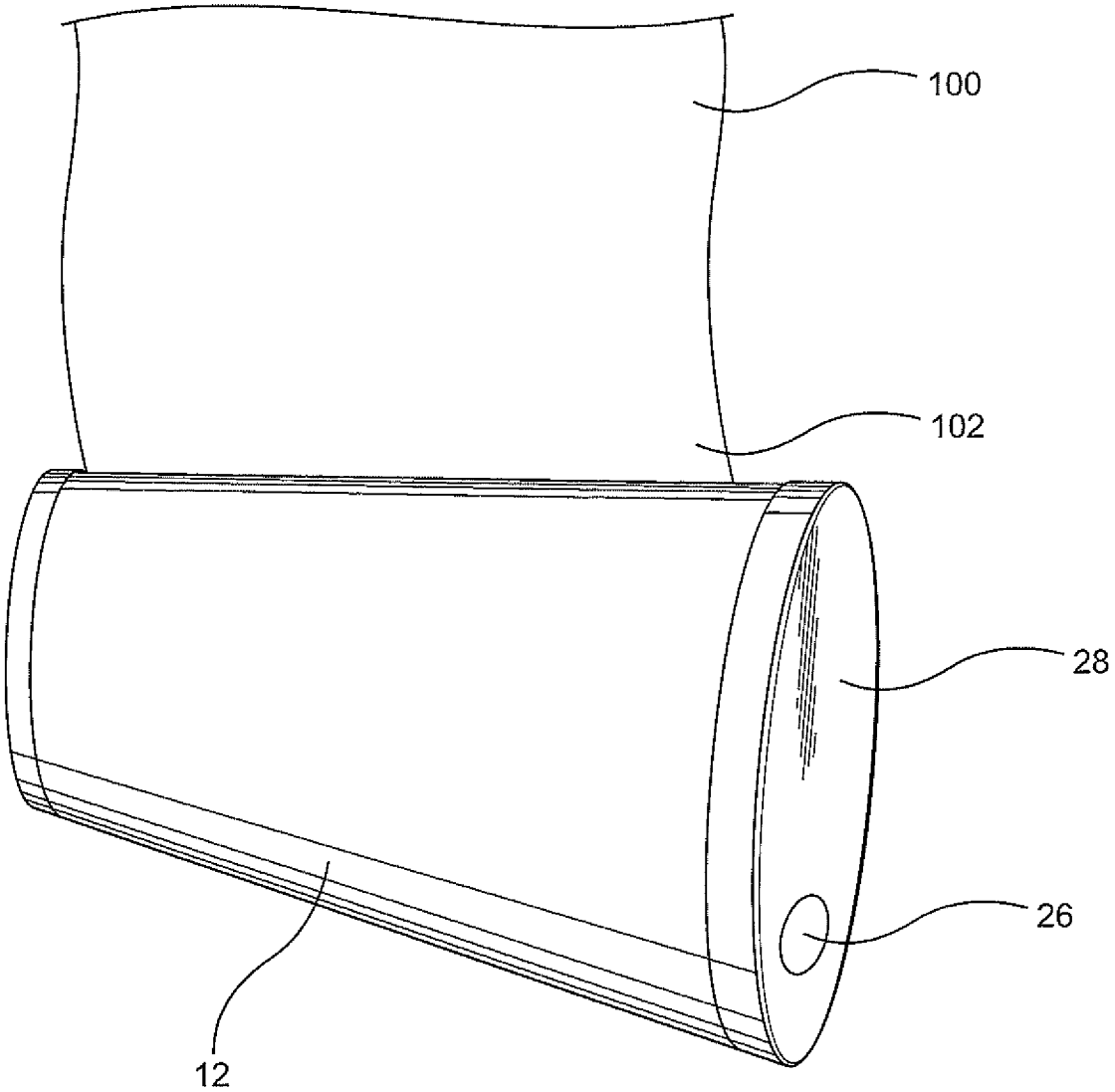
FIG. 4 is a perspective view of one of a possible plurality of operative orientations, methods, etc. of the bottom rail connected to a free end of the shade.
Figure 5:
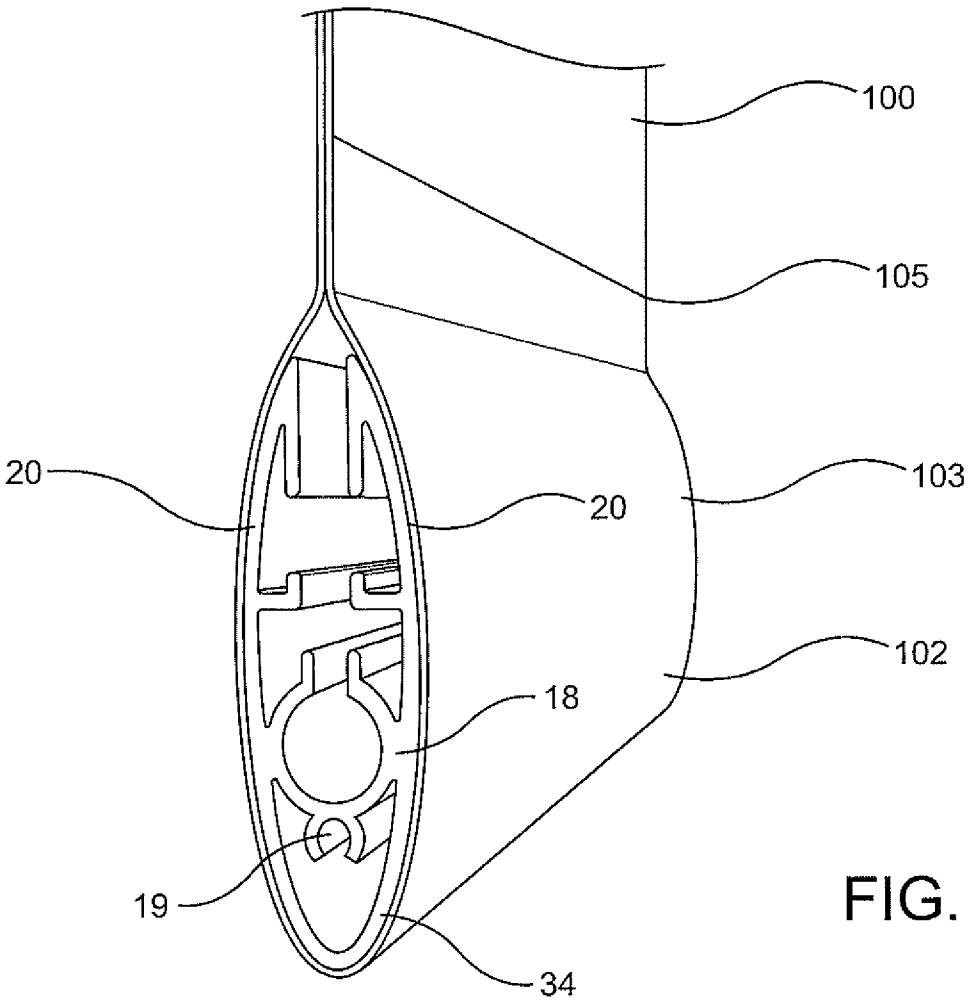
FIG. 5 is a perspective view of one other of a possible plurality of operative orientations, styles, methods, etc. of the bottom rail being connected within an interior of a pocket at the free end of the shade.
Figure 6:
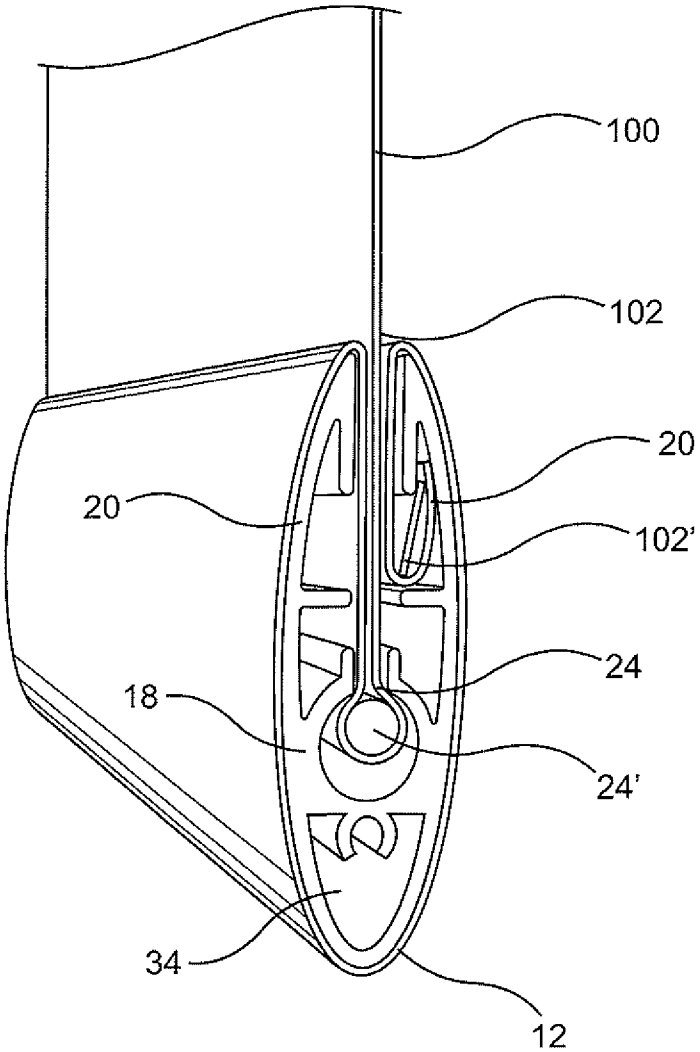
FIG. 6 is a perspective view of yet one other of a possible plurality of operative orientations, methods, styles, etc. of the bottom rail being wrapped about and to a free end of the shade.

As represented in the accompanying Figures, the present invention is directed to a bottom rail, generally indicated as 10, for a roller shade assembly of the type including a flexible material shade 100, as represented in FIGS. 4-6. It is noted that the bottom rail 10 could include, but not be limited to, a bottom rail hem bar. In typical or conventional fashion, the shade member 100 is removably disposed in a rolled configuration, about a support roller (not shown for purposes of clarity). Operation of the roller shade assembly, in terms of positioning and removing it in overlying relation to a window being shaded is facilitated by the support roller typically being operated by a clutch, spring or motor and disposed at the top end of a associated window.

As set forth in greater detail hereinafter, the structural and operative features of the bottom rail allow it to be connected to the bottom free end of the flexible shade, generally indicated as 102, in any one of a plurality of operative orientations. As discussed in greater detail hereinafter with primary reference to FIGS. 4-6, this versatile structuring allows the bottom rail 10 to be attached in different ways to the free end 102 of the shade 100, thereby individually defining different operative orientations of the bottom rail 10 when so connected.

In more specific terms, the bottom rail 10 includes an elongated base 12 dimensioned and configured to be connected to the free end 102 of the shade 100. Further, the elongated base 12 has a length sufficient to extend along substantially the entirety of the transverse dimension of the flexible shade 100. Further, the base 10 may be formed by extrusion from a plastic, aluminum or other appropriate material and as such has an at least partially hollow interior 14 extending along the length thereof.

The hollow interior comprises and/or is defined by a plurality of cavities 18-20, all or at least some of which extend along substantially the entire length of the hollow interior 14, due at least in part to the extruded formation of the base 12. Also, the base 12 includes an elongated slot or channel-like opening 16 formed preferably in an upper peripheral portion 12' of the base 12 and also extending along substantially the entire length of the base 12. This opening 16 communicates with the hollow interior 14, as well as at least some of the plurality of cavities 18-20, of the base 10. The elongated opening 16 is disposed and dimensioned to facilitate passage of the free end 102 of the shade member 100 into the hollow interior 14, dependent on the operative orientation of the base 12/bottom rail 10 when connected to the bottom or free end 102 shade member 100.

In at least one preferred embodiment, the plurality of cavities 18-20 disposed within an at least partially defining the hollow interior 14 include a retainer cavity 18, a connector cavity 19 and at least one, but preferably two receiving cavities each indicated as 20. Moreover, the retainer cavity 18 is structured to receive a retainer 24 therein. The retainer 24 may be in the form of an elongated retaining rod 24', which may be disposed in retaining engagement with at least a portion of the free end 102 disposed within the hollow interior 14, as represented in at least FIG. 6. Disposition of the free end 102 of the shade member 100 with the retainer rod 24' is accomplished by passing the free end 102 through the aforementioned elongated opening 16. Additional features of the retainer 24 may include the forming of the elongated retaining rod 24' from a variety of different materials. As a result, additional weight may be added to the bottom rail 10, when desired or required, by forming the retaining rod 24' from a heavier metallic material such as, but not limited to, steel, etc., rather than a lighter weight plastic material. When such a metallic or other heavier material is utilized, the retainer 24 and/or retaining rod 24' may be accurately described as including a "weighted construction".

Figure 3:
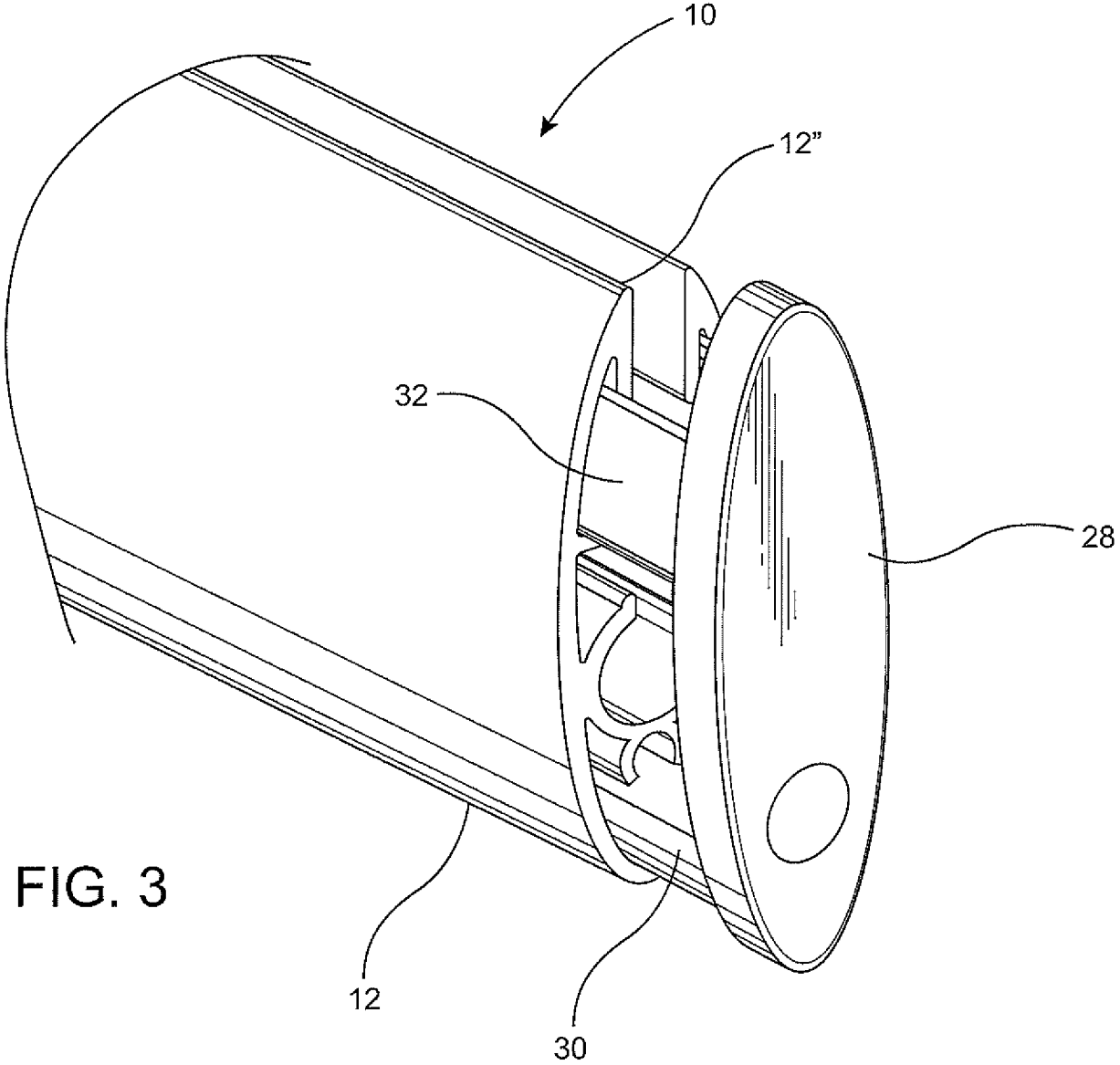
FIG. 3 is a perspective view in partial cutaway of the base and the end cap of the embodiments of FIGS. 1 and 2 respectively, in partially assembled form.

The aforementioned connector cavity 19 is disposed, dimensioned and configured to receive, retain and removably engage a connector 26 which serves to removably secure an end cap 28 to one or each open end 12" of the base 12, as represented in at least FIG. 3 and described in greater detail hereinafter. As also more fully described, the intended versatile utilization of the bottom rail 10, includes a preferred overall configuration of the base 12 and configuration and disposition of the plurality of cavities 18-20. Accordingly, the base 12 may be formed into an elongated elliptical configuration having a major axis schematically represented at 104, as represented in at least FIG. 1. The major axis 104 is disposed in at least partial alignment with the flexible shade 100 and its upward and downward direction of travel relative to the aforementioned support roller (not shown), when the base 12 is connected thereto. In cooperation with the elongated elliptical configuration of the base 12, the plurality of cavities 18-20 are collectively disposed in a symmetrical relation relative to the major axis 104 of the elliptical base 12. Therefore, due at least in part to the elongated elliptical configuration of the base 12 and the symmetrical disposition of the plurality of cavities 18-20, the bottom rail 10 will reliably demonstrate stability when attached to the bottom free end 102 of the shade material 100, in any of the possible operative configurations of the bottom rail 10, as represented in FIGS. 4-6.

Figure 1:
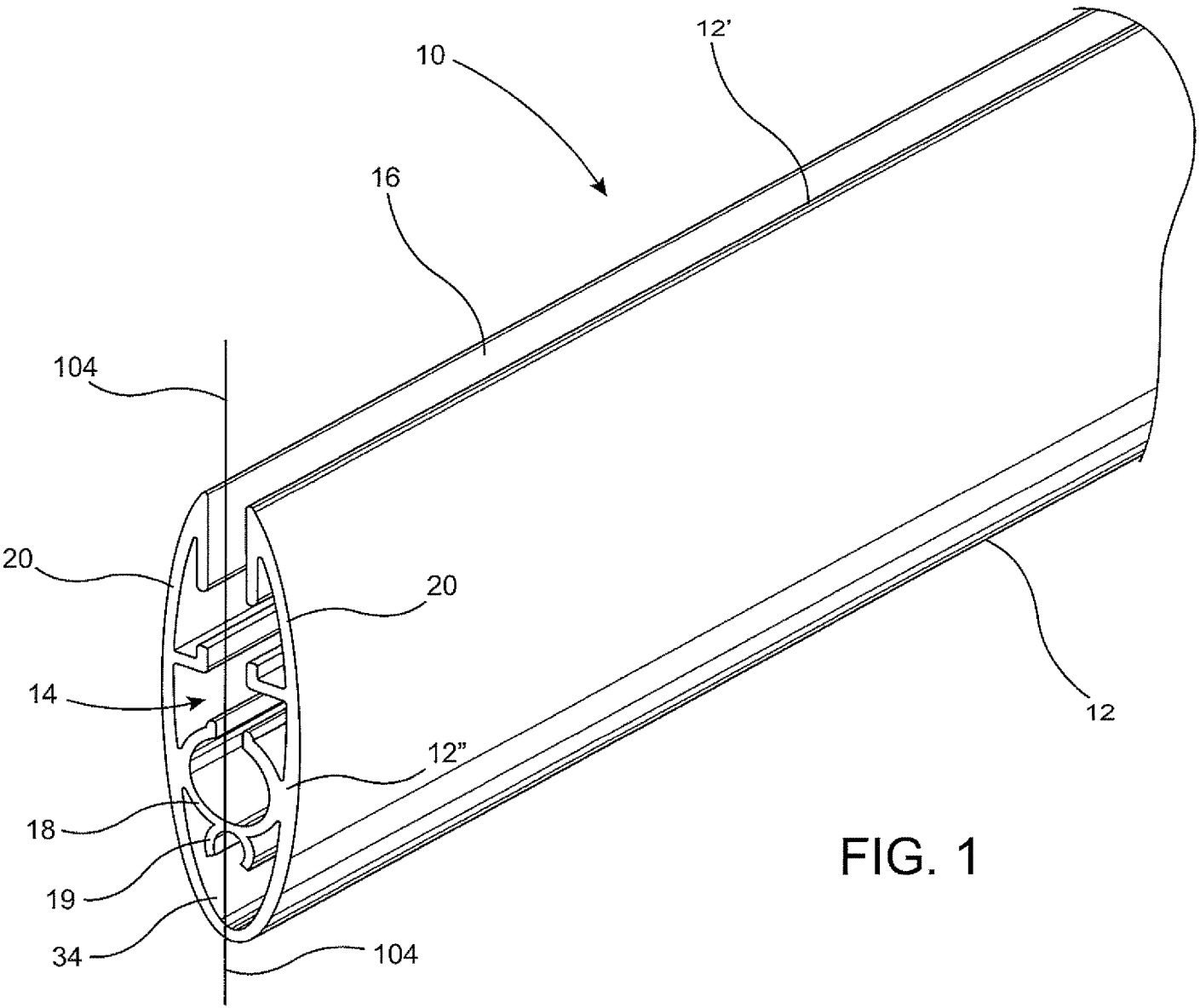
FIG. 1 is a perspective view of a partially assembled bottom rail of the present invention in an unattached relation to a shade.
Figure 2:
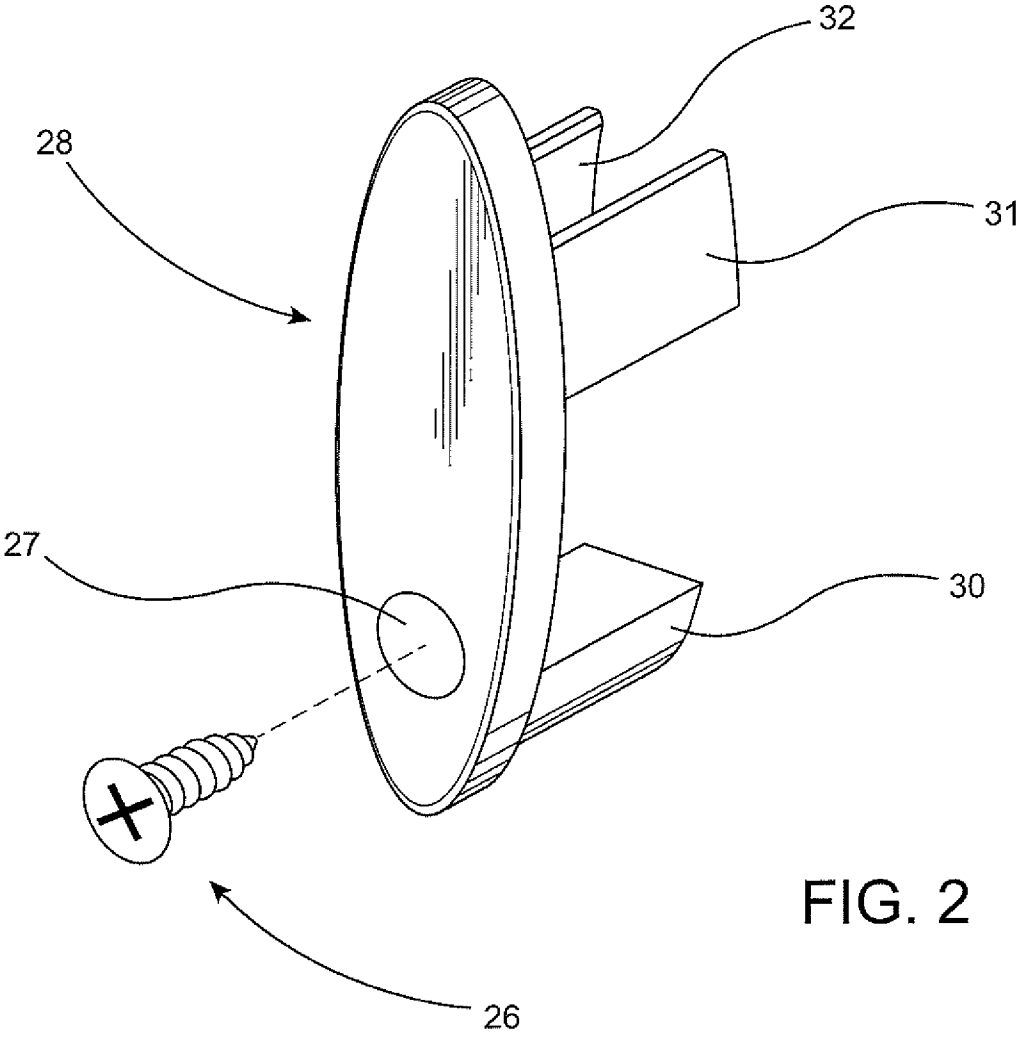
FIG. 2 is a perspective view in partially exploded form of an end cap removably connected to an open end of a base of the bottom rail of the embodiment of FIG. 1.

For purposes of clarity, at least one embodiment of the base 12, specifically including the plurality of cavities 18-20, comprises the inclusion of one retainer cavity 18 and one connector cavity 19, which may be disposed and/or interconnected to one another in close proximity, as clearly represented in FIG. 1. However, the interior portions of the retainer cavity 18 and connector cavity 19 are segregated in order to avoid a wrongful attachment of the aforementioned connector 26 and end cap 28 to a correspondingly disposed open end 12" of the base 12.

The collective symmetrical disposition of the plurality of cavities 18-20 is further defined by the inclusion of two opposed receiving cavities each indicated as 20, disposed on opposite sides of and in equally spaced relation to the major axis 104 of the elliptically shaped base 12 and hollow interior 14. Either of the receiving cavities 20 is disposed, dimensioned and configured to receive an extremity 102' of the free end 102 of the shade 100 passing into the hollow interior 14 through the aforementioned elongated peripheral opening or channel 16 formed in a periphery of the base 12, as represented in at least FIG. 6. The free end extremity 102' may be so disposed in a retaining engagement in one of the preferably two receiving cavities 20, dependent on the operative orientation of the bottom rail 10 which defines a manner of attachment of the base 12 to the free end 102 of the shade 100.

Therefore, in at least one preferred embodiment the aforementioned collective symmetrical disposition of the plurality of elongated cavities 18-20, within the hollow interior 14, may be even more specifically defined by the major axis 104 passing concurrently through the substantial center of both the retainer cavity 18 and the connector cavity 19 and between and in equally spaced relation to both of the preferably two opposed receiving cavities 20, as represented in FIG. 1.

As set forth above, the base 12 of the bottom rail 10 may also include end caps 28. Each of the two end caps 28 is removably connected in covering, overlying relation to a different one of possibly two, oppositely disposed open ends 12" of the base 12, in a manner represented in at least FIG. 3. As such, each of the end caps 28 comprise a plurality of fingers 30, 31 and 32, extending outwardly from an inner surface thereof. Each of the fingers 30-32 is cooperatively disposed, dimensioned and configured to be telescopically received into a correspondingly dimensioned and/or configured space of the hollow interior 14.

In at least one embodiment, the plurality of fingers 30-32 secured to the inner surface of the end cap 28, includes one of the plurality of three fingers, as at 30, dimensioned and configured to be telescopically received within an open space 34 of the hollow interior 14 located adjacent to the connector cavity 19. In cooperation therewith, two others of the plurality of engaging fingers, as at 31 and 32, are disposed in spaced relation to one another at generally an upper end of the end cap 28. Being so disposed, each of the engaging fingers 31 and 32 is angularly or otherwise oriented to be telescopically received within different ones of the receiving cavities 20. It is emphasized that the number, disposition, dimension and configuration of the plurality of fingers associated with the end cap 28 may vary and still be considered within the spirit and scope of the present invention. In order to assure a fixed, stable but removable attachment of the end cap 28 to one of the open ends 12" of the base 12, a separate connector 26, such as a screw or the like, passes through an appropriate aperture 27 in the end cap 28 and into the aforementioned connector cavity 19. As a result, the connector 26 may be removably threaded or otherwise removably mate with interior surface portions of the connector cavity 19.

Therefore, the bottom rail 10 includes a base 12 with a preferred elongated elliptical shape, having a hollow interior 14 including a plurality of collectively symmetrical cavities 18-20, all cooperatively structured to facilitate attachment to the free end 102 of a shade 100 in a plurality of different operative orientations, methods, styles, etc. as represented in FIGS. 4-6.

More specifically, with initial reference to FIG. 4 the plurality of operative orientations may include an external, exposed orientation. Accordingly the operative orientation of FIG. 4 comprises the distal end 102 of the shade 100 passing into the interior 14 of the base 12 through the elongated opening 16, wherein it is secured by the retaining rod 24'.

With reference to FIG. 5, the operative orientation, style, method etc. of the bottom rail 10 comprises an enclosed, hem bar orientation at least partially defined by the bottom rail 10 disposed within a pocket or channel 103 formed by the free end 102 being welded or otherwise connected, as at 105, to a remainder of the shade 100.

With reference to FIG. 6, the bottom rail 10 comprises a covered, wrapped orientation, method, style, etc. at least partially defined by the extremity 102' of the free end 102 of the shade 100 passing into the hollow interior and being retained within one of the receiving cavities 20, as represented. A remainder of the free end 102 and/or contiguous portion of the shade 100 is retained by the retaining rod 24' and extends outwardly through the elongated opening 16 in surrounding, wrapped, covering relation to the exterior of the base 12.

Each end cap 28 may be attached in the manner indicated to the base 12 of the bottom rail 10, dependent at least in part, on the operative orientation of the base 12 and bottom rail 10 when connected to the free end 102 of the shade 100, as set forth in greater detail above. Accordingly, it is to be noted that in the operative orientation of the bottom rail 10, as represented in FIG. 4, one or more of the end caps 28 may be connected in the manner described above to a corresponding open end 12" of the base 12. In contrast, end caps 28 may or may not be connected to the base 12, when the bottom rail 10 assumes the enclosed or covered operative orientations of FIGS. 5 and 6.

Therefore, the versatile operative and structural features of the bottom rail 10 of the present invention serves to overcome disadvantages associated with conventionally structured and designed bottom rails, by allowing the bottom rail 10 to assume anyone of a plurality of different operative orientations, when connected to the free end 102 of the shade 100 such as represented in, but not limited to, the operative orientations, methods, styles, etc. of FIGS. 4-6.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A bottom rail for a flexible material shade, said bottom rail comprising:

an elongated base dimensioned and configured to be connected to a free end of the shade, said base including a hollow interior extending along the length of said base, an elongated opening formed in an outer periphery of said base and extending along the length thereof;

said elongated opening is disposed in communication with said hollow interior and dimensioned to receive the free end of the shade therethrough, said hollow interior comprising a plurality of cavities, said plurality of cavities including a retainer cavity and a connector cavity and at least two receiving cavities;

said at least two receiving cavities disposed at an upper end of said base in receiving relation to the free end of the shade, upon passage of the free end through said elongated opening into said retainer cavity, an end cap connected in overlying relation to an open end of said base and including a plurality of fingers extending outwardly there from into said hollow interior, two of said plurality of fingers correspondingly dimensioned and configured to be received within said at least two receiving cavities and telescopically disposed therein concurrent to connection of said end cap to said base, and said retainer and connector cavities including interiors disposed in segregated relation to one another.

2. The bottom rail as recited in claim 1 wherein said retainer cavity is structured to receive a retainer therein, in retaining engagement with the free end of the shade.

3. The bottom rail as recited in claim 2 wherein said retainer cavity extends along at least a majority of the length of said base.

4. The bottom rail as recited in claim 2 wherein said retainer comprises an elongated rod comprising a weighted construction.

5. The bottom rail as recited in claim 1 wherein said connector cavity is structured to receive a connector therein.

6. The bottom rail as recited in claim 1 wherein said plurality of cavities are collectively disposed in a symmetrical orientation relative to a major axis of said hollow interior.

7. The bottom rail as recited in claim 6 wherein said at least two receiving cavities are equally disposed in spaced relation to said major axis on opposite sides thereof.

8. The bottom rail as recited in claim 6 wherein said major axis passes concurrently and equally through said retainer cavity and said connector cavity.

9. The bottom rails recited in claim 8 wherein a transverse section of said base and said hollow interior comprises an elongated elliptical configuration.

10. The bottom rail as recited in claim 1 wherein said end cap comprises the plurality of fingers extending outwardly there from into correspondingly dimensioned ones of said plurality of cavities of said hollow interior, concurrent to said attached, overlying disposition.

11. The bottom rail as recited in claim 1 further comprising a connector extending through said end cap in attachment with an interior of said connector cavity, concurrent to said end cap connected to said base.

12. The bottom rail as recited in claim 1 wherein said base, said hollow interior and said plurality of cavities are cooperatively structured for attachment to the free end of said shade in a plurality of different operative orientations.

13. The bottom rail as recited in claim 12 wherein said plurality of different operative orientations include an external, exposed orientation.

14. The bottom rail as recited in claim 13 wherein said plurality of different operative orientations include an enclosed hem bar orientation.

15. The bottom rail as recited in claim 14 wherein said plurality of different operative orientations include a covered, wrapped orientation.

16. The bottom rail as recited in claim 1 wherein the bottom rail comprises a bottom rail hem bar.

17. The bottom rail as recited in claim 1 wherein said plurality of fingers comprises at least three fingers, said at least three fingers including said two fingers and a third finger;

said third finger correspondingly dimensioned and configured to be received within an open space at a bottom end of said base, within said hollow interior, and disposed therein concurrent to said end cap connected to said base.

18. The bottom rail as recited in claim 17 wherein said retaining cavity is disposed intermediate said connecting cavity and said two receiving cavities, and said connector cavity is disposed at said open space at said bottom end of said base.

* * * * *